US005380402A

United States Patent [19]

Ryham et al.

[11] Patent Number: 5,380,402

[45] Date of Patent: Jan. 10, 1995

[54] REDUCING PULP MILL LIQUID DISCHARGE

[75] Inventors: Rolf Ryham, Roswell, Ga.; Tuomo S. Nykanen; Brian F. Greenwood, both of Glens Falls, N.Y.; Johan Gullichsen, Helsinki, Finland; Erkki Kiiskila, Karhula, Finland; Esko Mattelmaki, Varkaus, Finland; Joseph R. Phillips, Glens Falls, N.Y.; Jan Richardsen, Roswell, Ga.; Jarmo Soderman, Helsinki; Karl G. Wiklund, Karhula, both of Finland

[73] Assignee: Kamyr, Inc., Glens Falls, N.Y.

[21] Appl. No.: 959,905

[22] Filed: Oct. 13, 1992

Related U.S. Application Data

[63] Continuation-in-part of Ser. No. 922,334, Jul. 30, 1992.

[51] Int. Cl.[6] ..... D21C 11/12

[52] U.S. Cl. ..... 162/30.1; 162/29; 162/31; 162/DIG. 8; 60/648; 159/49; 159/47.3; 159/DIG. 8

[58] Field of Search ..... 162/30.1, 31, 47, 29, 162/DIG. 8; 60/648; 159/49, DIG. 8, 47.3

[56] References Cited

U.S. PATENT DOCUMENTS 2,258,401 10/1941 Badenhausen ..... 60/648
4,405,418 9/1983 Takemura ..... 204/95
5,116,595 5/1992 Scribner et al. ..... 423/478

OTHER PUBLICATIONS

W. Howard Rapson, "The Effluent-Free Bleached Kraft Pulp Mill", Tappi, vol. 56, No. 9, Sep. 1973, pp. 112–115.

Jaakko Poyry, "Closing Up the Bleach Plant".

Paul Conner, "A Cogeneration Study Considering Electric Rates Resulting from PURPA", Tappi, Aug. 1984, pp. 54–57.

*Primary Examiner*—W. Gary Jones
*Assistant Examiner*—Dean T. Nguyen
*Attorney, Agent, or Firm*—Nixon & Vanderhye

[57] ABSTRACT

A pulp mill has zero or minimum liquid discharges. The large amounts of liquid that must be processed to achieve this result are handled utilizing a multiple effect evaporator provided with heat from a steam exhaust of a condensing type steam turbine. Super heated steam from the recovery and bark boilers is fed to the turbine to generate electricity for the production of bleaching chemical and other uses in the mill. Three or four steam exhausts having different composite temperature and pressure values are taken from the turbine and used where most suitable in the pulp mill. For evaporation of bleach plant effluent the steam taken from the turbine preferably has a pressure of about 1–3 psia and a temperature of about 120°–140 ° F, and has no significant adverse affect on power generation.

22 Claims, 6 Drawing Sheets

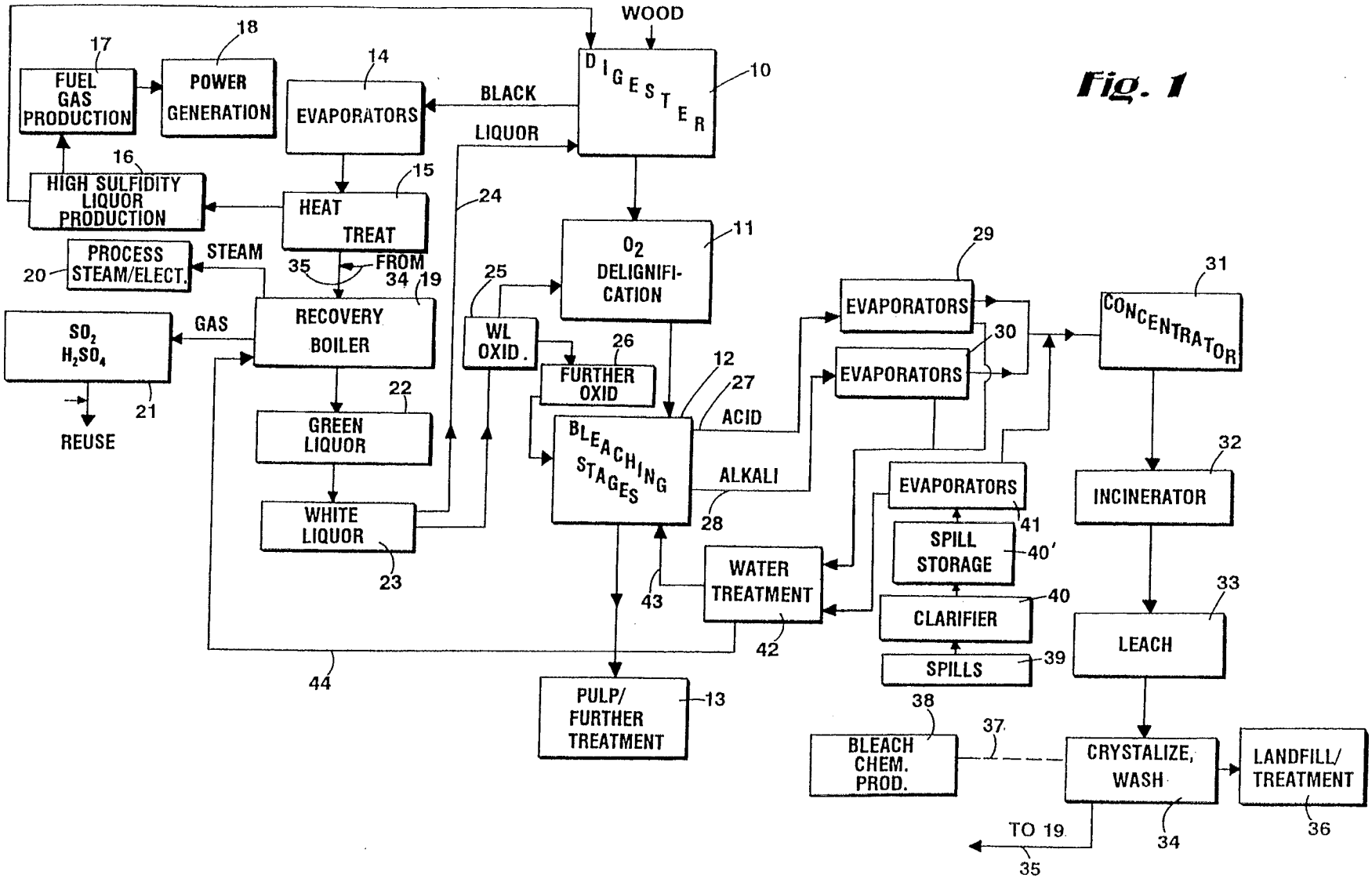
Fig. 1
WOOD
DIGESTER
10
BLACK
LIQUOR
EVAPORATORS
14
HEAT
TREAT
15
FROM
34
35
RECOVERY
BOILER
19
GREEN
LIQUOR
22
WHITE
LIQUOR
23
24
WL
OXID.
25
FURTHER
OXID
26
O2
DELIGNIFI-
CATION
11
12
27
ACID
BLEACHING
STAGES
ALKALI
28
43
WATER
TREATMENT
42
PULP/
FURTHER
TREATMENT
13
44
EVAPORATORS
29
EVAPORATORS
30
CONCENTRATOR
31
INCINERATOR
32
LEACH
33
CRYSTALIZE,
WASH
34
LANDFILL/
TREATMENT
36
TO 19
35
EVAPORATORS
41
SPILL
STORAGE
40'
CLARIFIER
40
SPILLS
39
37
BLEACH
CHEM.
PROD.
38
POWER
GENERATION
18
FUEL
GAS
PRODUCTION
17
HIGH SULFIDITY
LIQUOR
PRODUCTION
16
STEAM
PROCESS
STEAM/ELECT.
20
GAS
SO2
H2SO4
21
REUSE

TO FIG 2B

14
EVAP
RECOVERY BOILER
19
24
SD TANK
22
GREEN LIQUOR CLARIFIER
57
58
SLAKER CAUST
23
WHITE LIQ ECO FILTER
MUD FILTER
59
PC FILTER
60
25
WL OX
WL OX
SO2 H2SO4
PRCIP
N2 CO2 H2O SO2
COOL TOWER
COND TURB
MP STEAM LP STEAM
NCG
SO2 H2SO4
PRCIP
N2 SO2 H2O CO2
KILN
61

TO FIG 2A
WDYRD
45
HOG BOILER
46
FLY ASH
DIGESTER
10
BS WASH
47
SCREEN ROOM
48
PRESS
49
11
O2 DELIGN
PO WASH
50
12
51
D100
Eop
Dn
D2
52
53
54
29
1
2
3
27
28
30
EVAPORATORS
41
CONCEN-TRATOR
31
32
INCINERATOR
Na2SO4
NaCl
Na2CO3
METALS
LEACH
33
SPILL STORAGE
40'
40
CLARIF
38
39
SPILL CONT.
ClO2 PRODUCTION
37
13
WET END
55
42
WTR TRT. PLANT
SEALWATR
65
66
FEED WATER
DRYER
56
STORAGE
57'
CRYSTAL WASH
34
Na2CO3
Na2SO4
35
DREG
63
64
LAND FILL

TO FIG 3B

CHIPS IN
110
147
148
111
150
$O_2$
70
71
A
68
69
COOLING WATER IN
COOLING WATER OUT
129
127
TO
142
WATER TREATMENT PLANT
TANK
CLEAN COND.
131
FOUL COND.
DFF GAS
STRIPPED COND.
FRESH STM
FEED
HPS
HPS COND.
LIVE STIM. COND.
133
134
INCINER-ATE
LEACH
CRYSTALIZE, WASH
PROD LIQ
132
135
RECOVERY LOOP
119 etc.

REDUCING PULP MILL LIQUID DISCHARGE

CROSS REFERENCE TO RELATED APPLICATIONS

This application is a continuation-in-part of application Ser. No. 07/922,334 filed Jul. 30, 1992 (pending).

BACKGROUND AND SUMMARY OF THE INVENTION

It has long been a desire of those working in the paper pulp art to produce a pulp mill that does not in any way significantly pollute the environment. A number of proposals have been made for such a pulp mill in the past, but the desired goal has yet to be achieved. For example, a "closed mill" was constructed at Great Lakes Forest Products, Thunder Bay, Ontario, in the 1970s, but it was difficult to run the mill closed for extended periods of time as a result of corrosion problems in the recovery boiler, and elsewhere, due to chloride buildup. See "Bleaching in the Closed Cycle Mill at Great Lakes Forest Products Ltd." by Pattyson et al, Pulp & Paper Canada, Vol. 82, No. 6, pp. 113–122 (1981). In the Great Lakes mill, bleaching plant effluents were introduced directly into the chemical recovery loop, as shown schematically in U.S. Pat. No. 4,039,372.

More recently, it has been proposed by HPD and Jaakko Poyry that closing of a pulp mill can be accomplished by evaporating acid effluent and then returning tile $E_o$ bleach plant effluent to the brown stock washers. However that approach has yet to be successful, despite the utilization of inexpensive thin plastic film, falling film evaporators which allow effective evaporation of the bleaching chemicals, and it is believed unlikely that it will ultimately be successful because of the buildup of undesired chemicals due to the introduction of the flow from the $E_o$ stage back to the brown stock washing stage.

According to the present invention, a method and apparatus are provided which utilize only existing technology, so that future development of sophisticated additional equipment or processes is not necessary, which essentially can reduce the liquid polluting effluents from a pulp mill to zero, provide only a minimum amount of solid waste for disposal (and provide the high probability that such solid waste can be used in an environmentally acceptable manner), and minimize the production of gaseous $NO_x$ and $SO_x$ products, so that the only significant gaseous pollutant from the pulp mill is carbon dioxide.

One of the basic aspects of the present invention that makes it possible to achieve these beneficial results is to treat the bleaching effluents completely separately from the chemical recovery loop until the effluents are in a particularly desirable form, and to then introduce the chemicals in that desirable form into the recovery loop. Another significant aspect of the present invention is the essentially complete oxidation of white liquor produced in the chemical recovery loop, which is then returned to the bleaching stage so that the proper balance between the various chemical treatment sequences is provided. Another significant aspect of the present invention that allows the desired results to be achieved are the production on site at the pulp mill, directly from the effluent streams and gaseous waste streams themselves, of essentially all of the sulfur dioxide, sulfuric acid, caustic or caustic substitute, and (if utilized) chlorine dioxide necessary to effect treatment of the pulp and recovery of the chemicals. Another factor which minimizes the amount of bleach plant effluents so as to make a proper treatment thereof practical, is advanced digesting techniques where delignification can be extended so that the pulp—without significant strength loss—discharged from the digesting stages has a low Kappa No. (e.g. 24 or below) and then the pulp is subjected to oxygen delignification to reduce the Kappa No. still further (e.g. to 14 or below, typically 10 or below) before bleaching is effected, allowing the production of prime market pulp (e.g. 88–90 ISO).

In order to achieve substantially zero discharge from a pulp mill, it will be necessary to process about 30 to 40 tons of liquid per ton of pulp produced over and above the normal liquid processing requirements from the chemical recovery system. Also, it will be necessary to produce bleaching chemicals directly on site, which is a highly electricity intensive endeavor. Therefore in order to achieve the desired goals of the invention, it is highly desirable to utilize a condensing type steam turbine which is fed with super heated steam from the burning of organic wastes (concentrated black liquor, bark, etc.) from the pulp mill. Different steam exhausts are provided from the steam turbine, each exhaust having steam of different composite pressure and temperature values, and each different value being utilized in the manner most suited for it within the pulp mill. In particular, the substantially lowest heat and pressure composite value of the steam is used with multiple effect evaporators (such as metal-plastic film laminated evaporator elements) to evaporate the collected liquid wastes (such as bleach plant effluents, spills, and the like) within the pulp mill.

The ability to produce prime market pulp with minimal adverse affect on the environment, according to the invention, is a quantum leap forward in pulping technology, and allows fulfillment of a long felt need to accomplish this desirable result.

According to one aspect of the present invention, a method of operating a cellulose pulp mill so as to allow substantially zero discharge of pollutants therefrom, utilizing a condensing type steam turbine with at least one exhaust, is provided. The method comprises the steps of: (a) Producing super heated steam by burning organics containing waste products from the pulp mill. (b) Feeding the super heated steam to the condensing type steam turbine to generate a maximum amount of electricity from a given amount, temperature, and pressure of steam. (c) Exhausting steam from the at least one exhaust of the steam turbine. (d) Collecting liquid wastes from the cellulose pulp mill. And, (e) evaporating the collected liquid wastes using the exhausted steam from the at least one steam turbine as heating fluid for affecting evaporation to produce clean condensate and a concentrated liquid waste. Step (e) is practiced utilizing a multiple effect evaporator (e.g. having 6–10 falling film effects) with a temperature differential of about 1–4° C. (preferably 2–3° C.) between effects. Step (c) may be practiced to exhaust steam having a pressure of about 1–3 psia and a temperature of about 120°–140° F.

Step (c) is preferably further practiced utilizing steam at a predetermined first composite pressure and temperature value, and comprises the further step of withdrawing a second stream of steam from the steam turbine at a predetermined second composite temperature and pressure value greater than the first value, and a third exhaust stream having a third temperature and pressure composite value greater than the second value. The second and third streams are used where appropriate within the pulp mill, while the first stream is used for the evaporation of the collected liquid wastes.

According to another aspect of the present invention, a method of evaporating an industrial waste liquid stream to produce clean condensate in a concentrated waste steam, using a condensing steam turbine is provided. The method comprises the steps of: (a) Producing super heated steam by burning organic fuel. (b) Feeding the super heated steam to the condensing type steam turbine to generate electricity. (c) Exhausting steam from the exhaust of the steam turbine. (d) Evaporating the industrial waste liquid stream using the exhausted steam from the steam turbine as heating fluid for affecting evaporation.

According to yet another aspect of the invention, a method of minimizing effluents from a cellulose pulp mill having a digester, bleach plant, condensing type steam turbine, and a black liquor system containing a recovery boiler, and a chemical recovery loop, is provided. The method comprises the following steps: (a) Producing super heated steam by burning organics containing waste products from the pulp mill. (b) Feeding the super heated steam to the condensing type steam turbine to generate electricity. (c) Exhausting steam from the at least one exhaust of the steam turbine. (d) Evaporating liquid effluents from the bleach plant to a concentration level high enough for incineration, by using the exhausted steam from the at least one turbine as heating fluid, to produce a concentrated effluent. (e) Incinerating the concentrated effluent to produce a residue containing sodium, sulfate and carbonate. (f) Leaching the residue to produce a leachate. And, (g) feeding at least a substantial portion of the leachate to the chemical recovery loop associated with the recovery boiler.

The invention also contemplates, in the method of producing cellulose chemical pulp in a pulp mill which requires sulfur dioxide, sulfuric acid, electricity for the production of bleaching chemicals and other uses, and caustic, and which has process effluents, the following step: Directly at the pulp mill producing substantially all of the sulfuric acid, sulfur dioxide, electricity, and caustic, or caustic substitute, necessary to effectively produce chemical pulp at the pulp mill from the pulp mill process effluents, organic waste, and waste gas streams, so that no substantial amount of additional sulfuric acid, sulfur dioxide, or caustic, nor any electricity, are necessary from external sources. The electricity is produced by burning concentrated black liquor and organic cellulose solid wastes to produce super heated steam. Then the super heated steam is fed to a condensing type steam turbine, and spent steam from the steam turbine is exhausted at at least three different temperature and pressure composite values, each different exhaust used in a suitable mill process.

The invention also comprises a method of operating a cellulosic pulp mill so as to allow substantially zero discharge of pollutants therefrom, utilizing a condensing type steam turbine with at least three exhausts, comprising the steps of: (a) Producing super heated steam by burning organics containing waste products from the pulp mill. (b) Feeding the super heated steam to the condensing type steam turbine to generate electricity. (c) Exhausting steam from each of the at least three exhausts of the steam turbine, the pressure and temperature of the steam at each exhaust being different. And, (d) utilizing the different exhausted steam streams from the condensing turbine in different mill processes, the mill process in which each different steam stream is utilized and suited to utilization of steam of that particular pressure and temperature.

The evaporator means utilized preferably comprise a plurality of stages of metal-plastic laminate, falling film evaporators. Such evaporators are available from A. Ahlstrom Corporation of Helsinki, Finland, and Ahlstrom Recovery Inc. of Roswell, Ga. under the trademark "Zedivap", and described in co-pending application Ser. No. 07/974,060 filed Nov. 12, 1992, now abandoned (corresponding to Finnish Application 915424 filed Nov. 18, 1991, and the disclosure of which is incorporated by reference herein). Although other evaporators, such as desalination evaporators, also are feasible, the "Zedivap" TM evaporators are particularly advantageous and make the evaporating process for bleach plant effluents, and collected spills, practical.

It is the primary object of the present invention to provide for the production of cellulose chemical pulp with essentially zero discharge of liquid pollutants to the environment, with a minimum amount of gaseous pollution, and with the minimum amount of solid waste products, including by using a condensing type steam turbine with multiple exhausts. This and other objects of the invention will become clear from an inspection of the detailed description of the invention, and from the appended claims.

BRIEF DESCRIPTION OF THE DRAWINGS

FIG. 1 is a schematic view of the most basic components of one exemplary system according to the present invention, and for practicing exemplary methods according to the present invention;

FIG. 3A–B are schematics of an alternative system according to the present invention based upon the same concepts as the systems of FIGS. 1 and 2A–B only showing different details of the handling of bleach plant effluents, the particular bleach plant stages involved, and the like.

DETAILED DESCRIPTION OF THE DRAWINGS

Figure 2A:
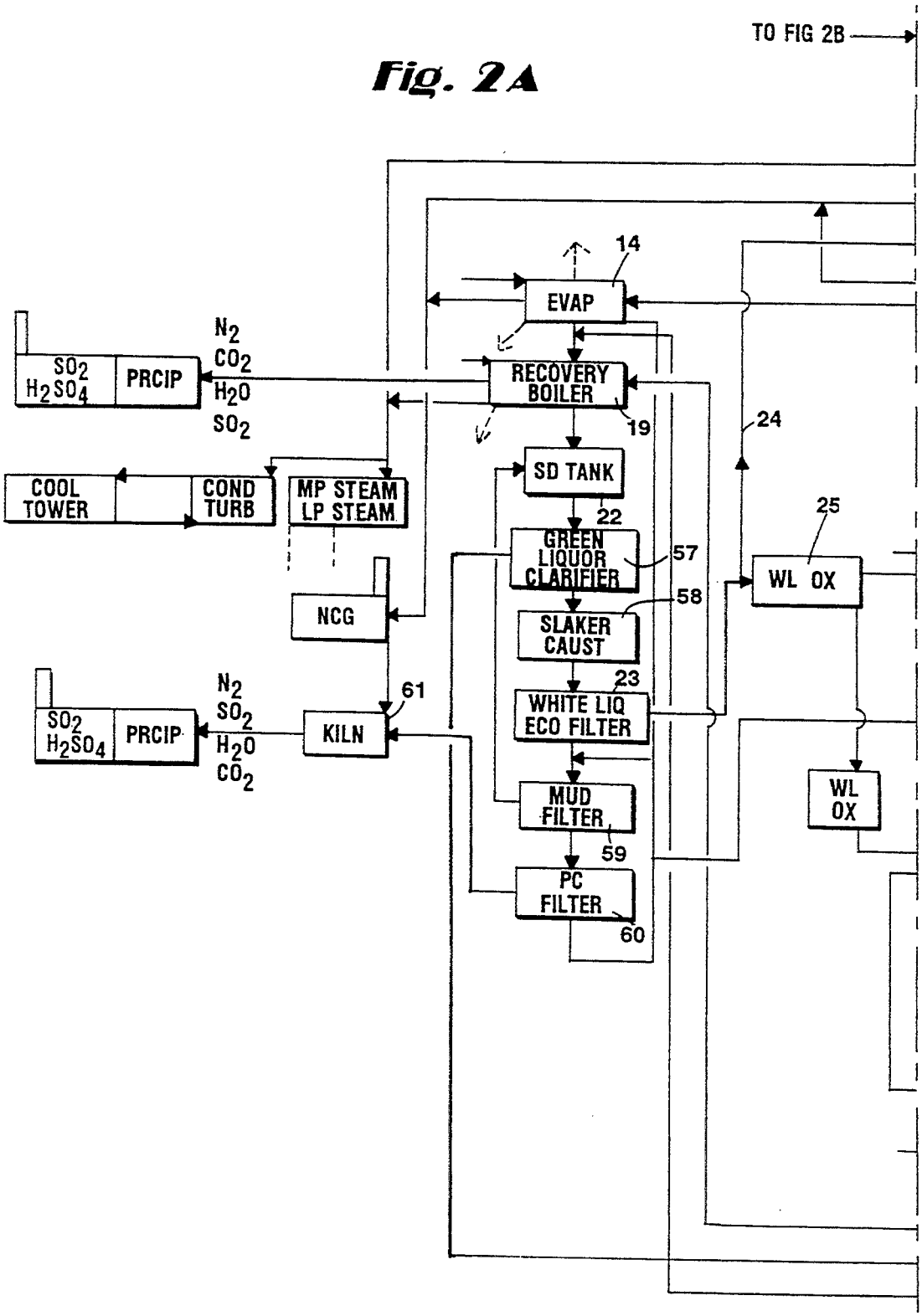
FIGS. 2A–B are flow sheets similar to that of FIG. 1, only showing a number of the particular processes involved in more detail.

The exemplary system illustrated in FIG. 1 includes a conventional digester 10, such as a Kamyr® continuous digester, to which hard wood or soft wood chips, or other comminuted cellulosic material, is fed. In the digester 10 the wood chips are acted upon by the cooking chemicals at conventional temperature and pressure conditions so as to produce chemical cellulose pulp, such as kraft pulp, which then is preferably subjected to oxygen delignification at stage 11. According to the present invention it is desirable to delignify the pulp so that it has a minimum Kappa No. when discharged from the digester 10, such as by using a Kamyr EMCC® digester and process, which produces a Kappa No. of about 24 or below. The oxygen delignification stage 11 reduces the Kappa No. to about 14 or below, preferably to about 10 or below.

After oxygen delignification, the pulp proceeds to the bleach plant 12 where it is subjected to bleaching in a plurality of different bleaching stages. The particular bleaching stages that are utilized can be varied, and are also dependent upon the particular cellulose material being treated. After the bleaching stages 12, the pulp may proceed on to storage or further treatment stages 13. For example the pulp may be dried and then shipped to a paper mill.

As is conventional, black liquor is withdrawn from the digester 10 (or brown stock washer associated therewith), and is passed to evaporators 14. The black liquor also is preferably subjected to heat treatment such as shown in U.S. Pat. No. 4,929,307 (the disclosure of which is hereby incorporated by reference herein). Sulfur containing gases driven off by the heat treatment 15 may be handled as shown in co-pending application Ser. No. 07/788,151 filed Nov. 5, 1991 now abandoned, for example to produce high sulfidity liquor at stage 16, where the production of fuel gas (e.g. primarily methane) as indicated schematically at 17, makes possible generation of power as indicated generally at 18.

After treatment at stage 15 the black liquor is ultimately passed (there may be intervening evaporation stages if desired) to a conventional recovery boiler 19. Steam produced from the recovery boiler 19, as indicated generally at 20 in FIG. 1, is used for various processes within the pulp mill. The gases discharged from the recovery boiler 19 include sulfur dioxide which can be used as the feed material for the production of sulfuric acid according to conventional techniques. As indicated at 21 in FIG. 1, sulfur dioxide and sulfuric acid (produced from the $SO_2$) can be used wherever necessary in the mill. For example the sulfur dioxide is used as an anti-chlor for the last stage of chlorine dioxide bleaching (if utilized), and for the tall oil plant. According to the invention, sufficient sulfur dioxide and sulfuric acid are available from block 21 to fulfill the needs of the pulp mill without requiring those chemicals from an external source. While of course one cannot expect the chemical recoveries and consumptions to balance exactly, according to the invention they may be expected to be within a few percent of each other. Of course any small amount of excess chemical can be sold, and any deficiency made up by purchase.

The melt from the recovery boiler 19, as is conventional, is used to form green liquor as indicated by reference numeral 22 in FIG. 1, and the green liquor is then preferably ultimately used to make white liquor, as indicated generally by reference numeral 23 in FIG. 1. Alternatively, or in addition, the green liquor may be crystallized and otherwise acted upon to produce essentially sulfur free sodium hydroxide, as disclosed in co-pending application Ser. No. 07/918,855 filed Jul. 27, 1992 (pending), the disclosure of which is incorporated by reference herein.

The sulfur content of the melt may be adjusted by bringing a portion of the melt discharged from the recovery boiler 19 into contact with a sulphurous gas of the pulp mill. Also, one can thermally split the methyl mercaptan and dimethyl sulphide of the sulphurous gas into ethene and hydrogen sulphide before it is brought into contact with the melt, or into contact with ash from the recovery boiler 19. Any white liquor produced from this melt will have controlled and/or enhanced sulfidity. These techniques are disclosed in Finnish Applications 914585 and 914586, both filed Sep. 27, 1991.

Some of the white liquor is fed via line 24 back to the digester 10, and according to the present invention, in order to balance the chemical flows, it is highly desirable that a portion of the white liquor from 23 be oxidized at stage 25 in a conventional or known manner, and then used in the oxygen delignification stage 11. One known manner of oxidation termed "bubbleless membrane aeration" is described in an article by Michael Semmens in the Apr., 1991 edition of "WATER-/Engineering & Management", pp 18 & 19. Also, a portion of the oxidized white liquor from 25 is preferably subjected to a second oxidation stage 26—such as shown in co-pending application Ser. No. 07/910,874, filed Jul. 9, 1992 (now abandoned) (the disclosure of which is hereby incorporated by reference herein)— in order to oxidize all of the sulfur forms within the white liquor to sulfates. The resulting essentially completely oxidized white liquor is then returned to the bleaching plant 12 and used in place of caustic in the bleach plant 12. Sufficient oxidized white liquor can be produced in 26 according to the invention so that all of the caustic needs for the bleach plant 12 are taken care of, without the necessity of requiring caustic from an external source.

Also according to the present invention, the liquid effluents from the bleach plant 12—such as the acid effluent in line 27 from the first bleaching stage, and the alkali effluent in line 28 from the second bleaching stage—are concentrated, e.g. by passage to evaporator stages 29, 30, respectively. The evaporators which comprise the stages 29, 30 preferably are low cost metal-plastic laminate, falling film evaporators, such as sold by A. Ahlstrom Corporation of Helsinki, Finland and Ahlstrom Recovery Inc. under the trademark "Zedivap". Such laminates are typically of aluminum (or brass or copper) and plastic (e.g. polyethylene, polypropylene, or polyester), each layer having a thickness of less than 100 $\mu$m. For example an aluminum layer may be 9–18 $\mu$m thick, and a polyester layer 12–25 $\mu$m thick. A plastic film may be extruded on a metal foil to produce a laminate. A heat exchanger is formed by attaching two rectangular laminated strips to each other, for example by a glued joint. The laminated strips may also be connected to each other by dot-like junction points between the joints at the edges. The pulp mill liquids may flow down the plastic layer, or the metal layer. Such an evaporator surface is disclosed in co-pending application Ser No. 07/974,060 filed Nov. 12, 1992 (now abandoned) (corresponding to Finnish Application 915424 filed Nov. 18, 1991, and the disclosure of which is incorporated by reference herein). However, conventional desalination evaporators may be used instead.

Where both acid and alkali liquid effluent lines 27, 28 are provided, it is desirable not to mix them until the effluents have been concentrated in the evaporators 29, 30 otherwise a severe foaming problem may ensue. If the foaming problem can be overcome, then the lines 27, 28 may be combined before the evaporators 29, 30.

After the stages 29, 30, the more concentrated effluent passes to the concentrator 31, which comprises a series of high-efficiency evaporator stages which concentrate the effluent to a sufficient level so that it can be incinerated. For example, the concentration of the effluent in lines 27 and 28 may be 0.2–0.5% solids, which is concentrated to a solids content of about 10–30% by the evaporators 29, 30, and then concentrated to a concentration of about 50–60% by the concentrator 31.

Concentration of the bleach plant effluents may be accomplished by other techniques aside from evaporation. For example, conventional ultra-filtration, reverse osmosis, freeze crystallization, or a combination of these techniques with each other and/or with evaporation, may be utilized to produce effluent with a sufficiently high concentration.

The concentrated effluent from the concentrator 31 or the like is fed to an incinerator 32 where it is burned to produce a residue. Incineration may be practiced according to a number of conventional or known techniques, such as slagging combustion or gasification (as by means of a circulating fluidized bed gasifier).

Valuable chemical components of the residue from incinerator 32 are ultimately returned to the recovery loop (i.e. components 14, 15, 19, 22, 23, etc.). In order to effectively return valuable components of the residue, such as sodium, sulfate, and carbonate, the residue is preferably leached by a conventional leaching apparatus, as indicated at 33 in FIG. 1. Preferably, the leachate from the leaching stage 33 is crystallized (e.g. freeze crystallized; see U.S. Pat. Nos. 4,420,318, 4,505,728, and 4,654,064) and washed as indicated at 34. Leaching and crystallizing per se (although in a recovery loop) are known as indicated by TAPPI Journal Volume 66, No. 7, Jul., 1983 "Recovering Chemicals in a Closed Sulfite Mill" by Davies et al.

The crystallized and washed leachate from stage 34 (or at least a portion thereof) is fed—via line 35— to the recovery loop, such as just before the recovery boiler 19. In that way the valuable chemicals from the bleach plant effluent in lines 27, 28 are returned to the recovery loop. The washing separates out metals above monovalent, such as calcium and magnesium, which may be land-filled or treated—as indicated at 36 in FIG. 1. The solid material at 36 is essentially the only solid waste material from the pulp mill of FIG. 1, and only comprises about 5% of the chemicals from the residue of incinerator 32, the other 95% being used elsewhere (e.g. in the recovery loop).

The residue from the incinerator 32 also typically includes sodium chloride, and the chlorine content thereof can be used—as indicated by dotted line 37 and box 38 in FIGURE 1—to produce chlorine dioxide and sodium chloride. In this circumstance, some of the leachate from stage 34 flows to the chlorine dioxide production stage 38, while the rest is returned to the recovery loop via line 35.

In many pulp mills, regardless of age, the amount of spill liquid can be a significant percentage of the total liquid effluents. Spill liquids as high as 33% of a mill total liquid effluents (including the bleach plant liquid effluents in lines 27, 28) are not unusual. Of course if such spills are allowed to leak into the environment, then the goal of a low or zero discharge mill will not be realized. Therefore according to the present invention, the liquid spills—preferably from the entire pulp mill—are collected utilizing conventional drainage and collection systems, as indicated schematically at 39 in FIG. 1. Those spills are then clarified in the clarifier 40, and passed to spill storage 40' and then to the evaporator stages 41. The evaporators in stages 41 are preferably Zedivap TM evaporators. The concentrated spills from the evaporators 41 are then combined with the concentrated effluents from evaporators 29 and 30, and passed to concentrator 31.

Of course all of the evaporator stages 29, 30, and 41 will produce water, which has been removed from the bleach plants effluents during the concentrating action thereof. The water from each of the evaporator stages 29, 30, and 41 is passed to a water treatment facility 42 which treats it so that it does not have any components which are harmful if the water is used for other purposes. This "recovery" of water is also a big advantage of the method and apparatus according to the invention. Part of the water is then returned, via line 43, to the bleach plant 12 to serve as wash liquid flowing countercurrently to the pulp from one stage to another in the bleach plant 12, while another part of the water passes in line 44, which goes to the recovery boiler 19 as feed water, for the production of process steam at 20.

Figure 2B:
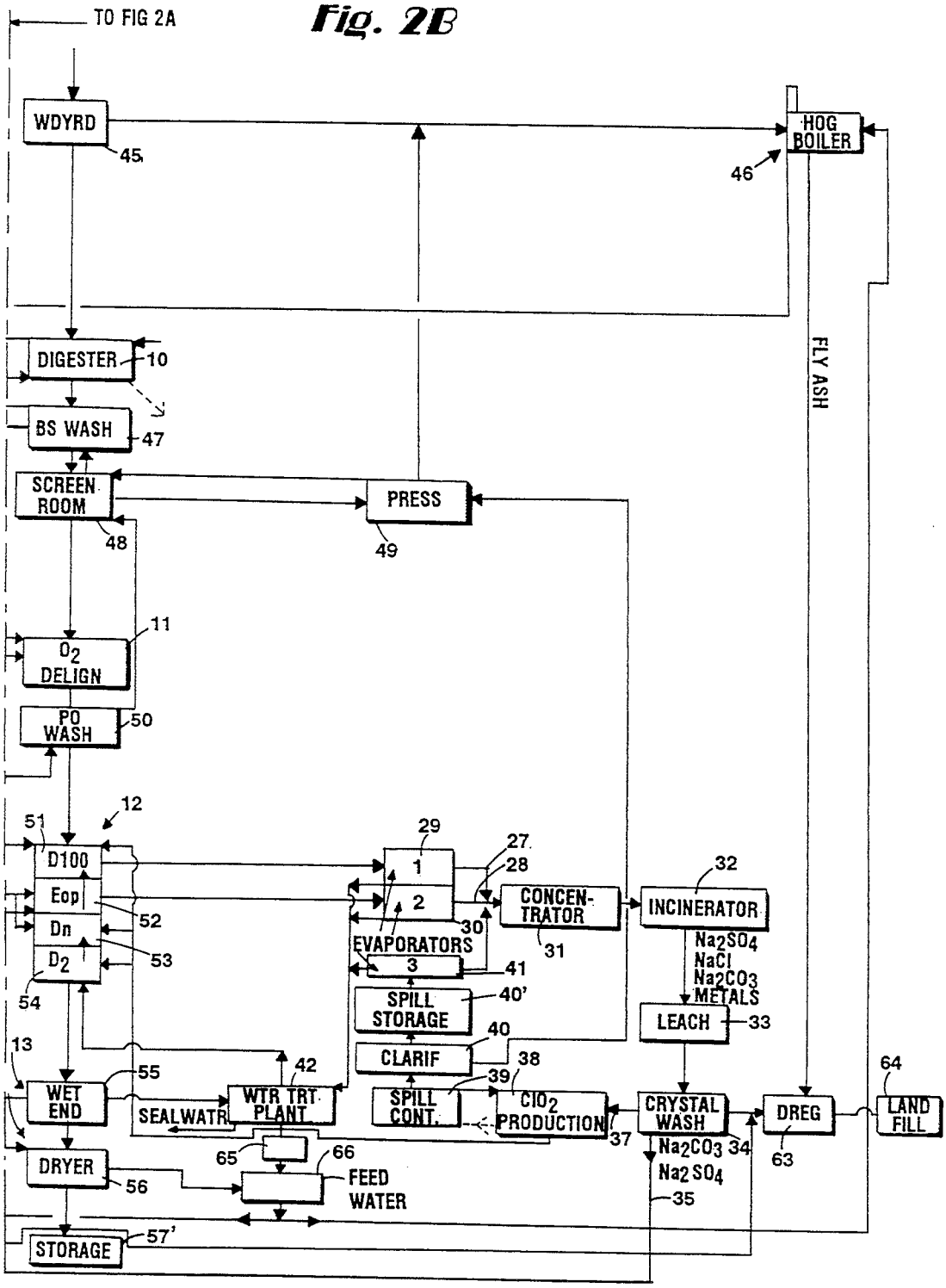

FIGS. 2A–B provide illustrations of the same basic system, for practicing the same basic method, as in FIG. 1, only shows a number of the components in more detail. In the illustration of FIGS. 2A–B components comparable to those in FIG. 1 are shown by the same reference numeral.

In the illustration in FIGS. 2A–B, a wood yard 45 is shown connected to the digester 10, and also to a conventional hog fuel boiler 46. A brown stock washing stage 47 is disclosed after the digester 10, as well as a screen room 48 cooperating with a press 49, the press 49 also connected to the clarifier 40. Downstream of the oxygen delignification stage 11 is a further washing stage 50, which is then connected to the first stage 51 of the bleach plant 12. In the embodiment illustrated in FIGS. 2A–B, the first bleaching stage 51 is a 100% chlorine dioxide stage. The second stage 52 is an $E_{op}$ stage, a source of caustic being provided by the oxidized white liquor from 26. A third bleach stage 53 is a neutral chlorine dioxide stage. That is a port, on of the oxidized white liquor from source 26 (or caustic) is added to the top of the tower of stage 53 in order to neutralize the pulp acidity. The fourth stage 54 is a last chlorine dioxide stage. Chlorine dioxide from the production stage 38 is fed to each of the stages 51, 53, and 54, while a portion of the wash water from the water treatment plant 42 enters the fourth stage The further treatment stages 13 in the FIGS. 2A–B illustration include the "wet end" 55 and dryer 56, which may be connected to a storage facility 57'.

As part of the recovery system, other conventional components are illustrated in FIGS. 2A–B such as the green liquor clarifier 57, the slaker 58 for causticizing the green liquor, and the lime mud handling components including the mud filter 59, pre-coat filter 60, lime kiln 61, etc.

Associated with the components acting upon the bleach plant effluents is the dregs stage 63, which may be supplied with the higher than monovalent metals from the crystallizing and wash stage 34, as well as fly ash from the hog fuel boiler 46. The materials from the dreg stage 63 may be passed to a land-fill 64, or treated to recover the chemicals therefrom, or the chemicals therein can be utilized in an environmentally acceptable manner.

Also illustrated in FIGS. 2A–B is an optional ozone treatment stage 65 for treating water from the water treatment plant 42. The water from plant 42 is ozonated before flowing to the feed water source 66 which supplies the recovery boiler 19, and which also receives water from the dryer 56. Water from the wet end 55 may pass to the water treatment plant 42, or to the interface between the second and third bleaching stages 52, 53.

Figure 3A:
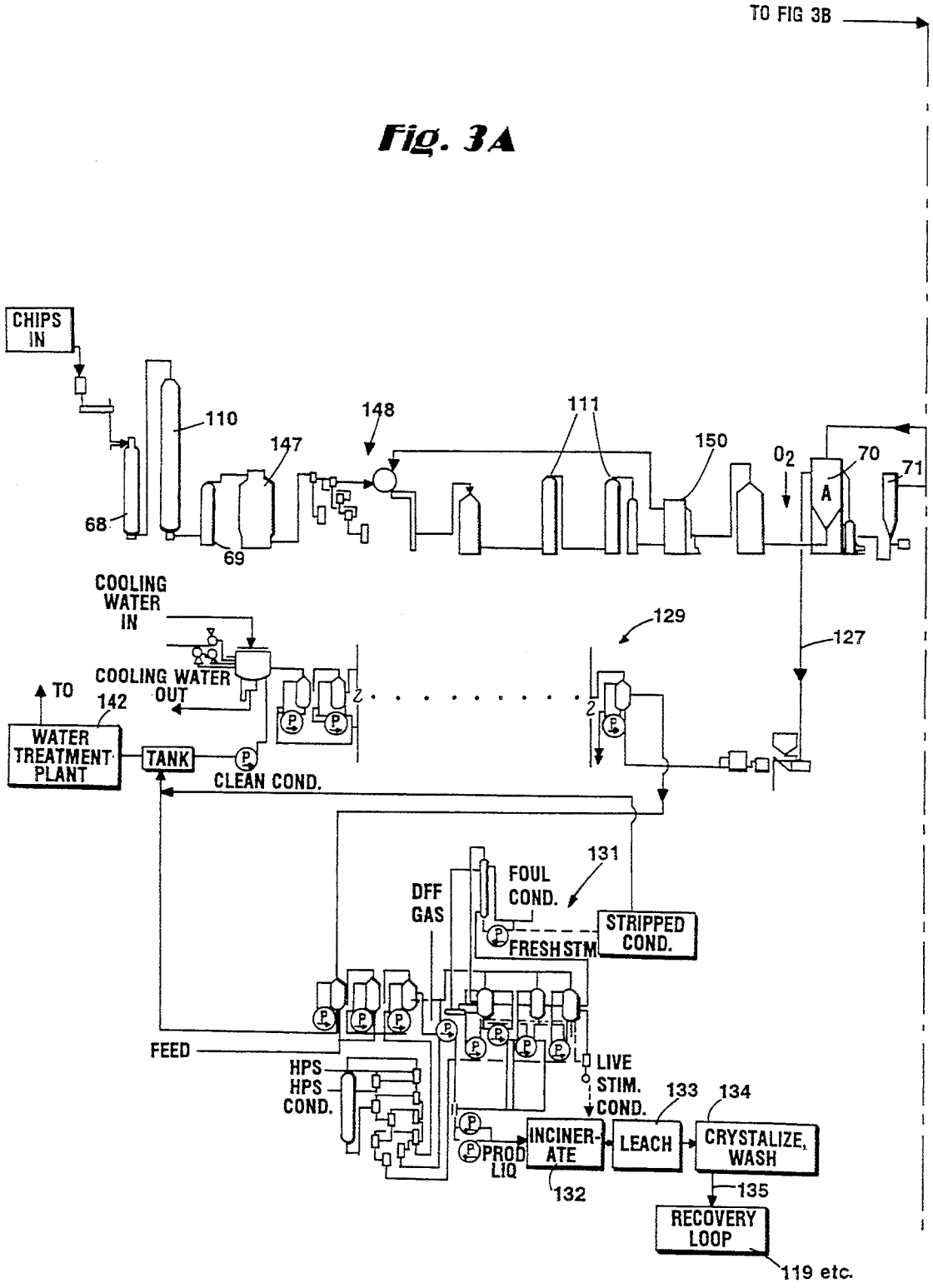
Figure 3B:
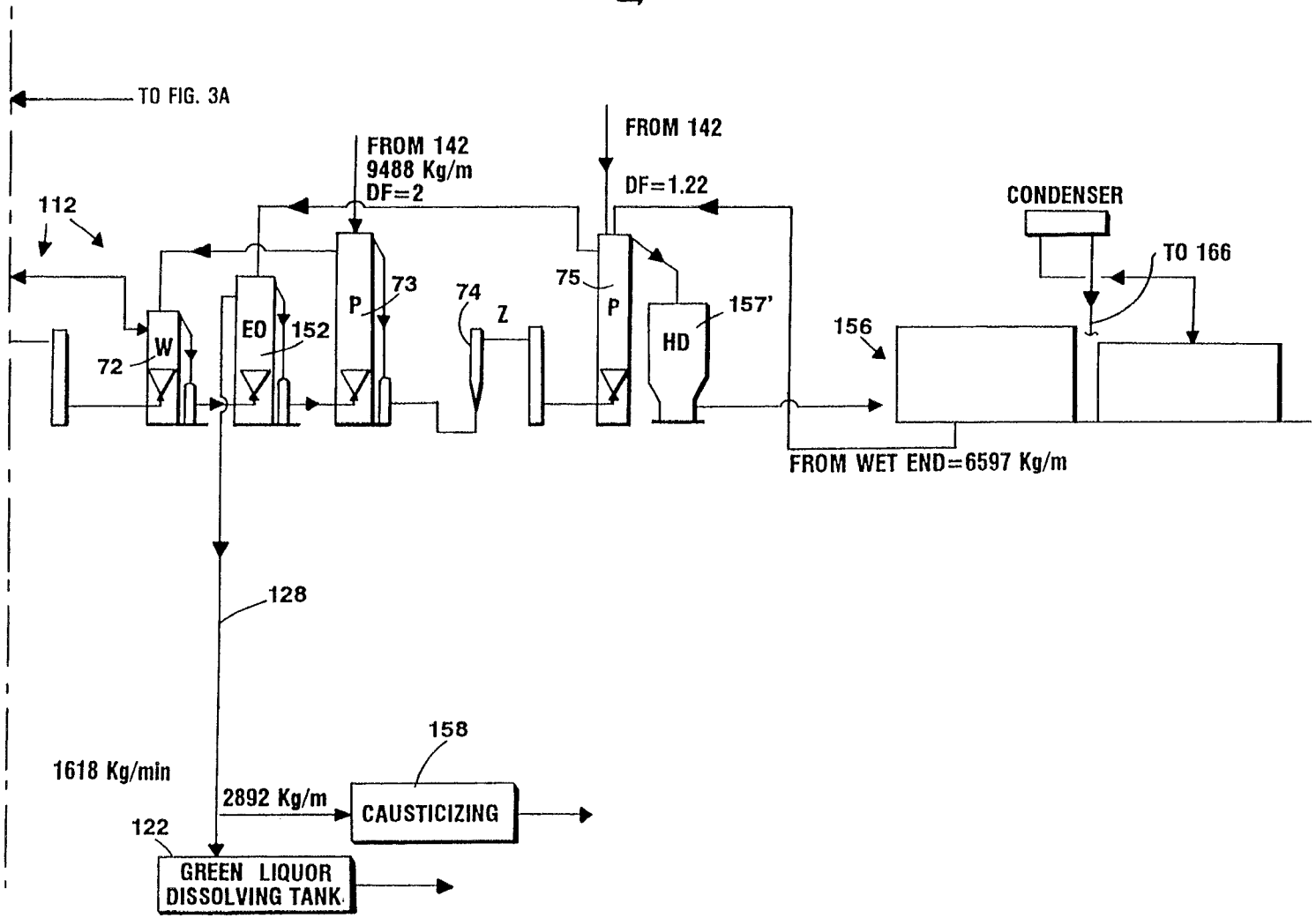

FIGS. 3A–B illustrate another alternative system according to the present invention. One of the major differences between the system of FIGS. 3A–B and that of FIGS. 1 and 2A–B is in the particular bleach sequence which is provided, namely an $AZE_oPZP$ bleach sequence. In FIGS. 3A–B components comparable to those in the FIGS. 1 and 2A–B embodiments are shown by the same reference numeral only preceded by a "1". Also FIGS. 3A–B schematically illustrates a number of the components used in the system rather than merely showing them in block diagram, as in FIGS. 1 and 2A–B.

The digester 110 may be part of a two vessel hydraulic system, including an impregnation vessel 68, such as an EMCC® digester sold by Kamyr, Inc. of Glens Falls, N.Y. A pressure diffuser, 69, or similar brown stock washer may be downstream of the digester 110, which in turn is connected to high-density storage tank, 147, and then the brown stock screen room 148. The oxygen delignification reactors 111 are connected to the post oxygen washing stage 150, which is then connected to the first bleach stage 70, in this case an acid, "A", stage. The second stage of the bleach plant 112 is the first ozone stage 71, and after a wash 72 the $E_o$ stage 152 is provided. Following the $E_o$ stage 152 is a first peroxide stage 73, then the second ozone stage 74, and the second peroxide stage 75, connected up to the high density storage tank 157'.

In the embodiment of FIGS. 3A–B, the acid bleach plant effluent line 127 is connected to the Zedivap TM evaporator stages 129, just like in the FIGS. 1 and 2 embodiment, which in turn are connected to the concentrator 131, incinerator 132, leach stage 133, and crystallizing and wash stage 134. However the alkaline effluent line 128 is not connected up to evaporators, but instead is connected up to the recovery loop, typically to the green liquor dissolving tank 122. Also a part of the alkali effluent in line 128 may be used for causticizing, e.g. connected to stage 158; however, much of the alkali effluent would be added to the post-oxygen washing stage.

The pulp mills of FIGS. 1 through 3, in addition to producing essentially zero liquid effluent discharges, produce little air pollution. Sulfur dioxide and other sulfur compounds are recovered from the recovery boilers 19, 119 stacks, and electrostatic precipitators are also provided in the stacks. Also, the recovery boilers 19, 119 and all the other components, such as incinerators 32, 132, are operated so as to have minimal $NO_x$ discharge. The major gaseous pollutant, then, from the pulp mill will only be carbon dioxide.

Figure 4:
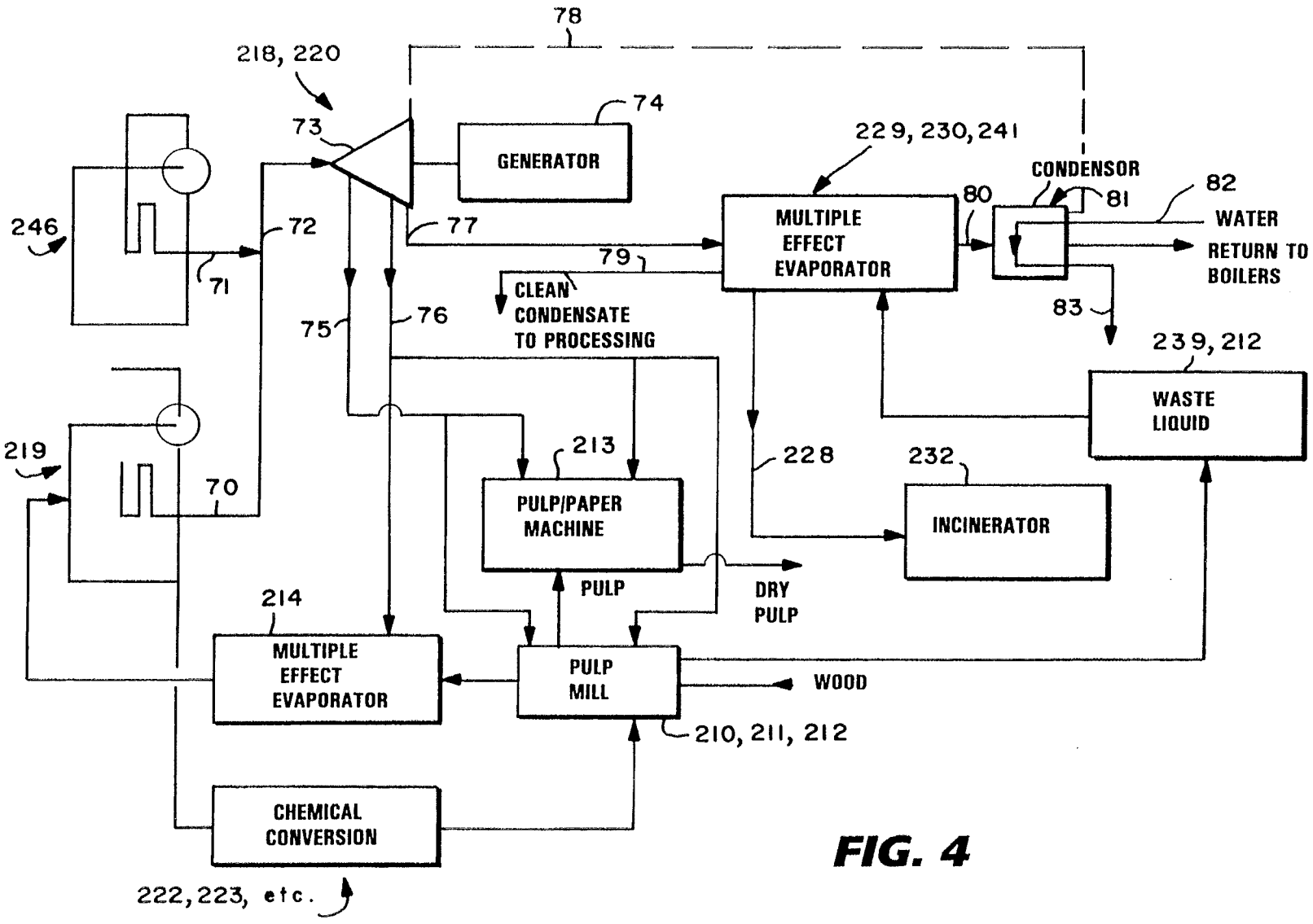
FIG. 4 is a schematic view of a system according to the present invention practicing a method of evaporating large volumes of liquid, and generating sufficient electricity to produce all of the bleaching chemical requirements of a pulp mill, utilizing a condensing type steam turbine.

FIG. 4 schematically illustrates a system that is particularly useful in generating sufficient electricity to provide all of the needs for the pulp mill, including for the production of bleaching chemicals such as chlorine dioxide (from sodium chloride), and/or ozone. The system of FIG. 4 also facilitates handling the large amount of waste liquids that must be handled in the closed mill of FIGS. 1 through 3. In the FIG. 4 embodiment, components comparable to those in the FIGS. 1 and 2A–B embodiments are shown by the same reference numeral only preceded by a "2".

In the FIG. 4 embodiment, the recovery boiler 219 and the bark boiler 246 (which burns solid organic, cellulose wastes associated with the mill) are used to produce super heated steam, being discharged in lines 70, 71, respectively, and combined in line 72 to be fed to a condensing type steam turbine 73, which is part of the power generation facility 218, 220. The turbine 73 drives a generator 74. Substantially all of the super heated steam from the boilers 219, 246 is fed to the turbine 73 (obviously multiple turbines can be provided) to generate substantially the maximum amount of electricity possible since large amounts of electricity will be necessary for producing bleaching chemicals, water treatment, and the powering of conventional electrical equipment in a pulp mill.

According to the present invention, a plurality (typically three or four) of exhaust streams of spent steam are taken off of the turbine 73. The conduits 75, 76, 77, and the optional conduit 78, illustrate these different streams. The stream taken off in line 75 has the highest composite temperature and pressure value, while that in line 76 has the second highest composite temperature and pressure value, and that in line 77 the next highest composite temperature and pressure value. If the exhaust conduit 78 is utilized, it has the lowest composite pressure and temperature value.

The highest pressure/temperature steam 75 is used in those portions of the pulp mill where primary steam is necessary, such as in those portions of the digester 210, oxygen delignification 211, or bleaching stages 212 that need primary steam, and also in the pulp/paper machine 213. The next highest grade steam in line 76 is used in the multiple effect evaporators 214 for concentrating of black liquor from the digester 210, while other portions of steam from the line 76 may be used for steaming of wood chips, or in other places within the mill where secondary steam is useful.

The steam withdrawn in exhaust line 77 is used in association with the multiple effect evaporator or evaporators 229, 230, 241 for concentrating various bleaching waste liquids, and spills that are collected from throughout the plant (see source 239, 212 in FIG. 4). As described earlier, the evaporators 229, 230, 241 preferably are metal/plastic film laminates, and may be operated with extremely low temperature differentials (e.g. about 1°–4° C., preferably about 2°–3° C.). Typically 6–10 evaporator effects of the falling film type of metal/plastic film laminates are utilized.

The steam in line 77 provides a total temperature differential across the evaporator 229, 230, 241 of about 20° C. The steam in conduit 77 needs to have a high enough composite pressure and temperature value so as to achieve this temperature differential., but should not have a higher value than that, which would be wasted (and thereby detract from the power produced by generator 74). Typically the steam in conduit 77 has a pressure range of about 1–3 psia and a temperature range of about 120°–140° F.; one specific exemplary value would be a temperature of about 130° F. and a pressure of about 1 psia (14.7 psia=1 atmosphere).

In the evaporator 229, 230, 241, clean condensate is produced in line 79, and is utilized as process liquid elsewhere in the pulp mill. The steam that does not condense passes in line 80 to a condenser 81, to which the steam in line 78 may be fed also (to condense). Cool water 82 is preferably used as the condensing fluid, and the heated water in line 83 is used in the pulp mill where preheated water is necessary or desirable.

The waste liquids (e.g. from the pulp mill 212 and from the collection of spill source 239) evaporated in the evaporator 229, 230, 231 pass in line 228 to the incinerator 232, for subsequent treatment as described in FIGS. 1 through 3.

The use of low pressure turbine exhaust steam (77) as a source for the bleach effluent evaporators (229, 230, 241) according to the invention is a comprehensive utilization of the available thermal energy in the most energy-efficient fashion. The nature (low consistency) of the bleach effluent allows it to be much more easily evaporated (that is requires less thermal energy) than the viscous black liquor. However a large volume of water must be evaporated (e.g. 25–30 ton/hr. compared to 6–10 ton/hr. for black liquor). The low viscosity of the beach plant effluent permits the use of low pressure (e.g. sub-atmospheric) steam at a high flow rate (4–5 ton/hr. for 1–3 psia steam in line 77). The other two, conventional, steam flows exiting the turbine (e.g. 75, 76) are typically 65#steam for black liquor evaporation in 214 at 1–2 ton/hr., and 165#steam for the digester 210 at 2–3 ton/hr. The adverse effect on power transmitted to generator 74 by removal at 77 is minimal, whereas if steam from line 75, 76 were utilized for evaporators 229, 230, 241, the adverse effect on power generation by generator 74 would be dramatic.

The system illustrated in FIG. 4, with the multiple steam exhausts 75–78 from the steam turbine 73, is specifically advantageous in a pulp mill, particularly one in which it is desirable to eliminate or greatly minimize liquid discharges. However, it is also applicable to other industrial processes in which large amounts of liquid must be processed, and there is a ready fuel source available for production of super heated steam.

It will thus be seen that according to the present invention an effective method and apparatus have been provided for absolutely minimizing effluents from a cellulose pulp mill. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of facilitating operation a cellulose pulp mill, having a bleach plant, and a black liquor system so as to allow minimum discharge of pollutants therefrom, utilizing a condensing type steam turbine with at least one exhaust, comprising the steps of:

(a) producing super heated steam by burning organic containing waste products from the pulp mill;

(b) feeding the super heated steam to the condensing type steam turbine to generate a maximum amount of electricity from a given amount, temperature, and pressure of steam;

(c) exhausting steam from the at least one exhaust of the steam turbine;

(d) collecting liquid wastes from the cellulose pulp mill, including substantially all liquid effluents from the bleach plant;

(e) evaporating substantially all the collected liquid wastes independent of the black liquor system using the exhausted steam from the at least one steam turbine as heating fluid for effecting evaporation to produce clean condensate and a concentrated liquid waste; and wherein the liquid polluting effluents is minimized.

2. A method as recited in claim 1 wherein step (e) is practiced utilizing a multiple effect evaporator with a temperature differential of about 1°–4° C. between effects.

3. A method as recited in claim 1 wherein step (e) is practiced utilizing an evaporator having 6–10 falling film effects with a temperature differential of about 2°–3° C. between effects.

4. A method as recited in claim 3 wherein step (c) is practiced to exhaust steam having a pressure of about 1–3 psia and a temperature of about 120°–140° F.

5. A method as recited in claim 1 wherein step (e) is practiced utilizing a multiple effect evaporator having a temperature differential between the first and last effects of about 20° C.

6. A method as recited in claim 1 wherein step (a) is practiced by burning concentrated black liquor from the digestion of cellulose, and by burning organic cellulosic solid waste.

7. A method as recited in claim 1 wherein step (d) is practiced by collecting liquid spills from throughout the pulp mill.

8. A method as recited in claim 7 wherein step (e) is practiced using a plurality of different multiple effect evaporators.

9. A method as recited in claim 1 wherein step (c) is practiced utilizing steam at a predetermined first composite pressure and temperature value; and comprising the further step of withdrawing a second stream of steam from the steam turbine at a predetermined second composite pressure and temperature value greater than the first value.

10. A method as recited in claim 9 comprising the further step of utilizing the second stream of steam to evaporate black liquor produced during cellulose digestion in the pulp mill.

11. A method as recited in claim 10 comprising the further steps of withdrawing a third stream of steam from the steam turbine at a predetermined third pressure and temperature value, greater than the second value; and utilizing the third stream of steam as primary steam to facilitate the production of cellulose pulp in the pulp mill.

12. A method as recited in claim 1 wherein step (c) is practiced to exhaust steam having a pressure of about 1–3 psia and a temperature of about 120°–140° F.

13. A method as recited in claim 12 wherein step (c) is practiced utilizing steam at a predetermined first composite pressure and temperature value; and comprising the further step of withdrawing a second stream of steam from the steam turbine at a predetermined second composite pressure and temperature value greater than the first value.

14. A method as recited in claim 13 comprising the further step of utilizing the second stream of steam to evaporate black liquor produced during cellulose digestion in the pulp mill.

15. A method as recited in claim 14 comprising the further steps of withdrawing a third stream of steam from the steam turbine at a predetermined third pressure and temperature value, greater than the second value; and utilizing the third stream of steam as primary steam to facilitate the production of cellulose pulp in the pulp mill.

16. A method of minimizing effluents from a cellulose pulp mill having a digester, bleach plant, condensing type steam turbine, a black liquor system containing a recovery boiler and chemical recovery loop, comprising the steps of:

(a) producing super heated steam by burning organics containing waste products from the pulp mill;

(b) feeding the super heated steam to the condensing type steam turbine to generate electricity;

(c) exhausting steam from the at least one exhaust of the steam turbine;

(d) evaporating substantially all liquid effluents from the bleach plant independent of the black liquor system to a concentration level high enough for incineration, by using the exhausted steam from the at least one turbine as heating fluid to produce a concentrated effluent;

(e) incinerating the concentrated effluent independent of the black liquor system to produce a residue containing sodium, sulfate and carbonate;

(f) leaching the residue to produce a leachate; and (g) feeding at least a substantial portion of the leachate to the chemical recovery loop associated with the recovery boiler.

17. A method as recited in claim 16 comprising the further steps of:

(h) removing black liquor from association with the digester;

(i) increasing the solids concentration of the black liquor to a level high enough for incineration;

(j) incinerating the concentrated black liquor in the recovery boiler to produce a melt;

(k) producing white liquor and/or substantially sulfur free NaOH from materials in the recovery loop including from the melt and the leachate fed to the recovery loop;

(l) oxidizing at least a part of the white liquor; and (m) using at least a part of the oxidized white liquor in place of caustic in the bleach plant.

18. A method as recited in claim 17 comprising the further steps of: collecting spills of liquid from the pulp mill; evaporating the collected spills to a concentration level high enough to be incinerated utilizing the steam exhausted from the steam turbine, and adding the concentrated spills to the concentrated bleach plant effluents to practice step (e).

19. A method as recited in claim 16 wherein step (c) is practiced to exhaust steam having a pressure of about 1–3 psia and a temperature of about 120°–140° F.

20. A method as recited in claim 19 wherein step (c) is practiced utilizing steam at a predetermined first composite pressure and temperature value; and comprising the further step of withdrawing a second stream of steam from the steam turbine at a predetermined second composite pressure and temperature value greater than the first value.

21. A method as recited in claim 20 comprising the further step of utilizing the second stream of steam to evaporate black liquor produced during cellulose digestion in the pulp mill.

22. A method as recited in claim 21 comprising the further steps of withdrawing a third stream of steam from the steam turbine at a predetermined third pressure and temperature value, greater than the second value; and utilizing the third stream of steam as primary steam to facilitate the production of cellulose pulp in the pulp mill.

* * * * *